US006893310B2

(12) United States Patent
Nakatani

(10) Patent No.: US 6,893,310 B2
(45) Date of Patent: May 17, 2005

(54) APPARATUS AND METHOD FOR ADJUSTING SPARK GAP OF SPARK PLUG

(75) Inventor: Hiroshi Nakatani, Kuwana (JP)

(73) Assignee: Denso Corporation, Kariya (JP)

( * ) Notice: Subject to any disclaimer, the term of this patent is extended or adjusted under 35 U.S.C. 154(b) by 52 days.

(21) Appl. No.: 09/953,430

(22) Filed: Sep. 17, 2001

(65) Prior Publication Data

US 2002/0034915 A1 Mar. 21, 2002

(30) Foreign Application Priority Data

Sep. 18, 2000 (JP) ..... 2000-282254
Jun. 28, 2001 (JP) ..... 2001-197094

(51) Int. Cl.[7] ..... H01T 21/02
(52) U.S. Cl. ..... 445/7
(58) Field of Search ..... 445/3, 4, 7, 63, 445/64; 73/118.1; 123/153; 29/33 M, 33 N

(56) References Cited

U.S. PATENT DOCUMENTS 4,465,952 A * 8/1984 Sato et al. ..... 313/136
5,741,963 A * 4/1998 Nakatani et al. ..... 445/7
6,193,575 B1 * 2/2001 Nakatani ..... 445/4

FOREIGN PATENT DOCUMENTS

JP A-2000-200670 7/2000

* cited by examiner

*Primary Examiner*—P. Austin Bradley
*Assistant Examiner*—Felix O. Figueroa
(74) *Attorney, Agent, or Firm*—Posz Law Group, PLC

(57) ABSTRACT

A spark plug gap adjustment system is provided which is designed to adjust a spark gap between a ground electrode and a center electrode installed in a spark plug to a target value. The system determines the position of the ground electrode in a given coordinate system to calculate a target distance required to move an end of the ground electrode toward an end of the center electrode for bringing the spark gap into agreement with the target value and moves the ground electrode under pressure by the target distance to define a desired spark gap. This achieves the spark gap adjustment precisely at high speeds.

9 Claims, 2 Drawing Sheets

APPARATUS AND METHOD FOR ADJUSTING SPARK GAP OF SPARK PLUG

BACKGROUND OF THE INVENTION

1. Technical Field of the Invention

The present invention relates generally to an apparatus and a method for adjusting or defining a desired spark gap of spark plugs precisely at high speeds.

2. Background Art

Typical spark plugs consist of a center electrode, a metal housing or shell retaining the periphery of the center electrode through a porcelain insulator, and a ground electrode secured in the metal shell so as to face the center electrode. The interval between the center electrode and the ground electrode is adjusted to, for example, 1 mm to define a suitable spark gap.

Japanese Patent No. 2636814 discloses a spark gap adjustment method. This method includes steps of holding a spark plug, capturing an image of the spark plug around ends of a center electrode and a ground electrode through a CCD camera to produce an image signal, processing the image signal to measure the interval between the ground electrode and the center electrode, and pressing an outer wall of the ground electrode toward the center electrode using a press unit to adjust the ground-to-center electrode interval to a desired value.

In order to improve the productivity of spark plugs, quick adjustment of the spark gap is sought. The above method, however, performs the step of pressing the ground electrode while measuring the ground-to-center electrode interval and thus encounters a problem that the speed at which the press unit is moved to push the ground electrode depends upon the time required to measure the ground-to-center electrode interval, and too fast pushing the ground electrode will make it difficult to measure the ground-to-center electrode interval precisely.

For instance, if the time required to scan one frame of an image captured by the CCD camera is 0.2 sec., a typical tolerance of a 1 mm spark gap is 0.1 mm, therefore, an allowable maximum speed of the press unit will be 0.5 mm/sec. Increasing the accuracy of measuring the ground-to-center electrode interval requires decreasing the speed of the press unit.

SUMMARY OF THE INVENTION

It is therefore a principal object of the invention to avoid the disadvantages of the prior art.

It is another object of the invention to provide an apparatus or a method for defining a desired spark gap of a spark plug between a ground electrode and a center electrode precisely at high speeds.

According to one aspect of the invention, there is provided a method of adjusting a spark gap of a spark plug precisely at high speeds. The method comprises the steps of: (a) holding the spark plug having installed therein a center electrode and a ground electrode which have ends opposed to each other; (b) measuring a location of the end of the center electrode to determine a target distance required to move the end of the ground electrode toward the center electrode for bringing a gap between the ground electrode and the center electrode into agreement with a target value as a function of the measured location; and (c) pressing the end of the ground electrode toward the center electrode using a press device to move the end of the ground electrode the target distance to bring the gap between the ground electrode and the center electrode into agreement with the target value.

In the preferred mode of the invention, the press device includes a press head which has a contact surface which comes in contact with an outer surface of the end of the ground electrode when the ground electrode is pressed and a stepped surface which continues from the first surface and faces the end of the ground electrode through a given gap when the ground electrode is pressed.

The method further comprises the step of measuring an interval between the end of the ground electrode and the end of the center electrode to determine whether the measured interval is greater than the target value of the gap between the ground electrode and the center electrode or not after the end of the ground electrode is pressed toward the center electrode through the press device and the step of correcting the target distance the ground electrode is to be moved toward the center electrode so as to compensate for a difference between the target value and the measured interval.

According to another aspect of the invention, there is provided a spark plug gap adjustment apparatus. The apparatus comprises: (a) a holder which holds a spark plug having installed therein a ground electrode and a center electrode which are opposed to each other; (b) a press unit which works to press an end of the ground electrode toward the center electrode so as to decrease an interval between the end of the ground electrode and an end of the center electrode; and (c) a controller which measures a location of the end of the ground electrode held by the holder to calculate a target distance required to move the end of the ground electrode toward the end of the center electrode for bringing a gap between the ground electrode and the center electrode into agreement with a target value as a function of the measured location. The controller controls an operation of the press unit to move the end of the ground electrode the target distance.

In the preferred mode of the invention, the controller captures an image of a portion of the spark plug around the end of the ground electrode to determine a position of the end of the ground electrode in a given coordinate system and calculates the target distance as a function of the determined position.

The controller calculates a difference between the target value of the gap between the ground electrode and the center electrode and an interval between the ground electrode and the center electrode after the press unit moves the ground electrode the target distance and corrects the target distance so as to compensate for the difference between the target value and the interval.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
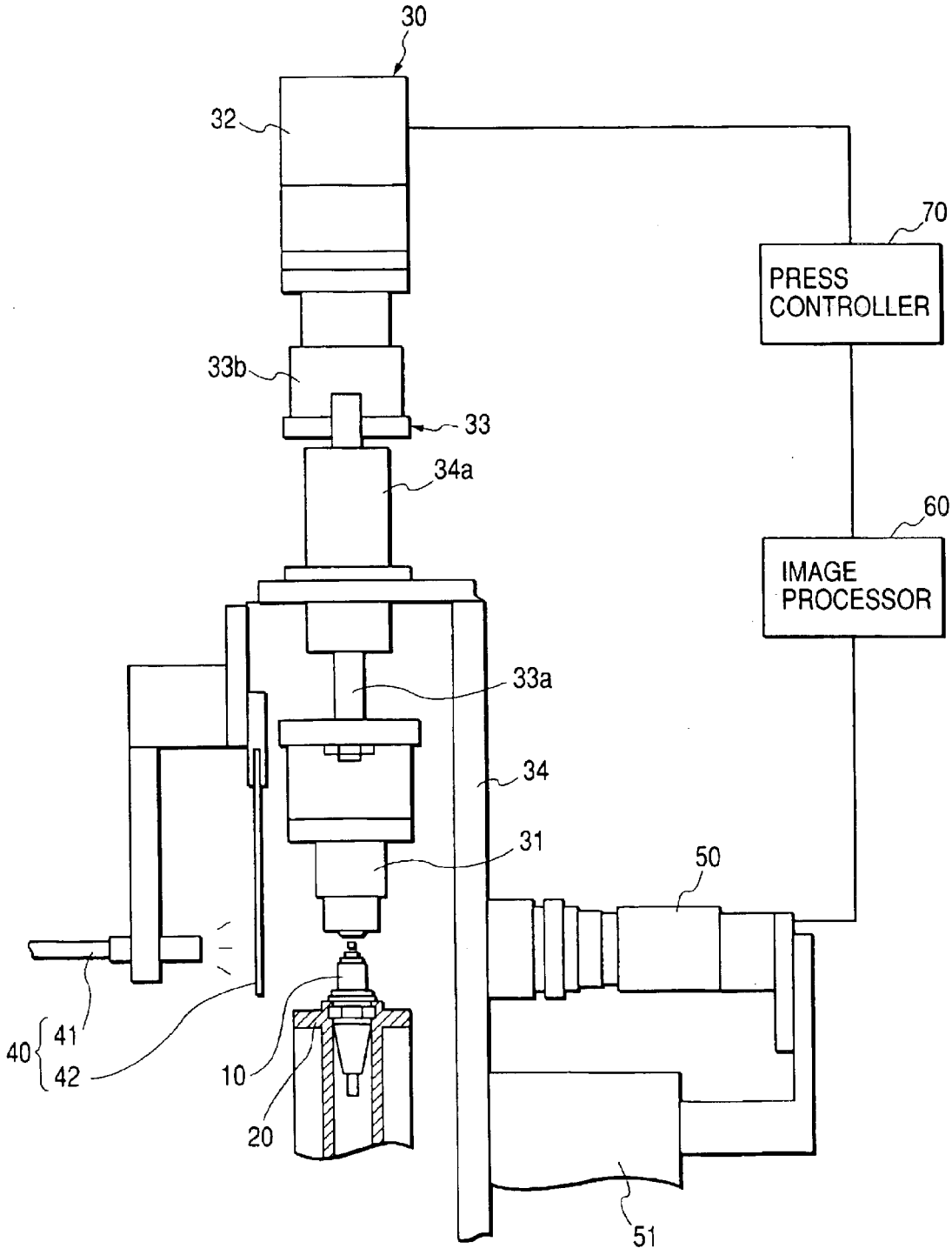
FIG. 1 is a plan view which shows a spark plug gap adjustment apparatus according to the present invention.

Referring to the drawings, particularly to FIG. 1, there is shown a spark plug gap adjustment apparatus according to the invention which is designed to define a desired interval between a ground electrode and a center electrode of a spark plug, which will also be called a spark gap below.

Figure 2:
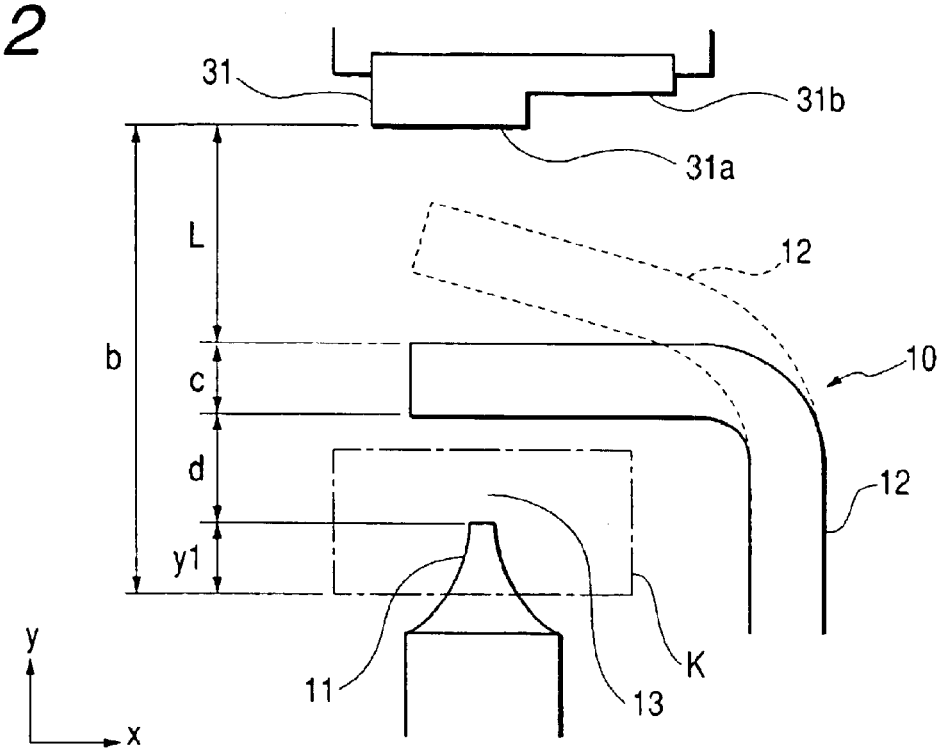
FIG. 2 is a partial view which shows a press head working to press a ground electrode toward a center electrode to bring a ground-to-center electrode interval into agreement with a target gap.

FIG. 2 shows a typical spark plug 10 for use in internal combustion engine, for example, which consists of a center electrode 11 retained in a porcelain insulator (not shown) and a ground electrode 12 installed in a metal shell (not shown). The ground electrode 12 is bent at an end thereof to define a desired spark gap 13 between itself and an end of the center electrode 11. A broken line in FIG. 1 indicates the ground electrode 12 bent temporarily before final adjustment of the ground-to-center electrode interval. The center electrode 11 and the ground electrode 12 are made of a known material. The ground-to-center electrode interval is adjusted by the spark plug gap adjustment apparatus of this embodiment to, for example, 1 mm.

Referring back to FIG. 1, the spark plug gap adjustment apparatus generally includes a plug holder 20, a press unit 30, a lighting unit 40, a camera 50, an image processing unit 60, and a press controller 70. The plug holder 20, as shown in the drawing, holds the spark plug 10 upright with the spark gap 13 oriented upward. The press unit 30 works to push the ground electrode 12 for decreasing the interval between the ground electrode 12 and the center electrode 11. The lighting unit 40 works to emit light toward the ground-to-center electrode interval of the spark plug 10. The camera 50 captures an image of a portion of the spark plug 10 around ends of the center and ground electrodes 11 and 12 and provides a signal indicative thereof to the image processing unit 60. The press unit controller 70 controls an operation of the press unit 30. The spark plug 10 in FIG. 1 is the one as viewed from the left side in FIG. 2.

The press unit 30 consists of a press head 31, a servomotor 32, an output shaft 33, and a base frame 34. The servomotor 32 is connected to the press head 31 through the output shaft 33 and works to move the press head 31 up and down. The base frame 34 is secured on a stationary base (not shown) and holds the output shaft 33 rotatably.

The output shaft 33 consists of a rotary shaft 33*a* and a joint 33*b* connecting the rotary shaft 33*a* and the servomotor 32. The rotary shaft 33*a* is inserted through a ball screw unit 34*a* installed on the base frame 34 and has the press head 31 installed on an end thereof projecting from the ball screw unit 34*a*.

The press unit 30 is activated by the press controller 70 to move the press head 31 through the output shaft 33 downward to press an outer wall of the ground electrode 12 to adjust the ground-to-center electrode interval of the spark plug 10 and to lift the press head 31 upward after the desired spark gap 13 is established.

The press head 31, although not always necessary in this invention, has, as clearly shown in FIG. 2, a flat surface 31*a* and a recessed surface 31*b*. The flat surface 31*a* works to press the ground electrode 12 in direct contact therewith. The recessed surface 31*b* is kept at a given interval away from the ground electrode 12 while the ground electrode 12 is being pressed by the flat surface 31*a*1. This establishes a constant engagement of the press head 31 with the ground electrode 12, thus resulting in increased accuracy of adjustment of the ground-to-center electrode interval. Additionally, the formation of the recessed surface 31*b* on the press head 31 allows a sectional area of the press head 31 to be increased, thus resulting in increases in strength and wear resistance of the press head 31.

The lighting unit 40 consists of an optical fiber 41 and a diffusion plate 42. The optical fiber 41 is connected to a light source (not shown) and emits light. The diffusion plate 42 diffuses the light from the optical fiber 41 uniformly over the ground-to-center electrode interval of the spark plug 10. The optical fiber 41 and the diffusion plate 42 are retained by the base frame 34.

The camera 50 may be implemented by a CCD camera and installed on a mount base 51 secured on the base frame 34 so that an optical axis of the camera 50 may be aligned with an optical axis of the optical fiber 41. The camera 50 captures an image of the ground electrode 12 and the center electrode 11 of the spark plug 10 and provides an image signal to the image processing unit 60.

The image processing unit 60 has disposed therein a known image processing processor which processes the image signal inputted from the camera 50 according to a given algorithm to locate the center electrode 11 and the ground electrode 12 in a coordinate system. The image processing unit 60 can be of any known structure, which is not essential part of this invention, and explanation thereof in detail will be omitted here.

The press controller 70 may be implemented by a programmable logic controller (PLC) and works to actuate the servomotor 32 for controlling the movement of the press head 31 based on a positional relation between the center electrode 11 and the ground electrode 12 derived by the image processing unit 60.

Figure 3:
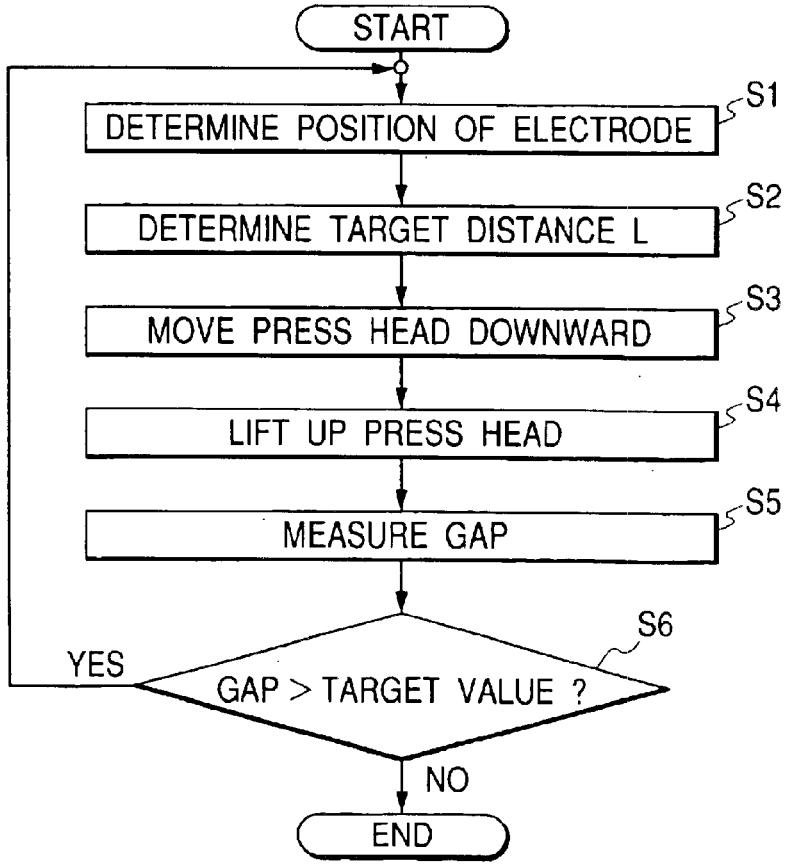
FIG. 3 is a flowchart of a program performed by the spark plug gap adjustment apparatus of FIG. 1 to adjust a ground-to-center electrode interval to a target gap.

FIG. 3 shows a flowchart of a program or logical steps performed by the spark plug gap adjustment apparatus of this embodiment to define the desired spark gap 13 of the spark plug 10.

Prior to start of the program, the spark plug 10 is mounted manually or using an automatic handling unit in the plug holder 20 with the tip thereof oriented upward. The ground electrode 12 is, as indicated by the broken line in FIG. 2, bent temporarily before installed in the plug holder 20 so that the end thereof may face the end of the center electrode 11 through a gap greater than the desired spark gap 13.

Upon pushing a start switch of the spark plug gap apparatus, the routine proceeds to step 1 wherein the location of the tip of the center electrode 11 is measured. Specifically, the lighting unit 40 is activated. The camera 50 captures an image around the tip of the center electrode 11 and provides a signal indicative thereof to the image processing unit 60. The image processing unit 60 processes the inputted image to determine the position of the tip of the center electrode 11 in the coordinate system.

For instance, the camera 50 produces an image signal indicating an image within a rectangular range, as indicated by a broken line K in FIG. 2. The image processing unit 60 defines a lower left corner of the rectangular range as an origin of an xy coordinate system and determines a y coordinate of the tip of the center electrode 11 or the distance y1, as shown in FIG. 2, which will also referred to as a center electrode tip coordinate distance y1 below.

The routine proceeds to step 2 wherein the target distance L required to move the press head 31 downward for adjusting the ground-to-center electrode interval to a target value is determined. Specifically, the location (i.e., a y coordinate b) of the press head 31, the thickness c of the ground electrode, and a target interval d between the center electrode 11 and the ground electrode 12 are fixed and known in advance. The image processing unit 60 stores these values and determines the target distance L by subtracting the sum of the values c, d, and y1 from the value b.

The y coordinate of the tip of the center electrode 11 as measured by the image processing unit 60 usually changes between spark plugs because the distance the tip of the center electrode 11 projects from the porcelain insulator is different between the spark plugs, however, the measurement of the center electrode tip coordinate distance y1 ensures the accuracy of determination of the target distance L at all times.

The routine proceeds to step 3 wherein the image processing unit 60 outputs a signal indicative of the target distance L to the press unit controller 70 to move the press head 31 downward by the target distance L. Specifically, the press unit controller 70 determines a target number of turns of the servomotor 32 as a function of the target distance L and provides a control signal to the servomotor 32. The servomotor 32 then rotates in a normal direction to move the press head 31 downward to push the ground electrode 12 toward the center electrode 11 until the ground-to-center electrode interval reaches the target value d. The speed at which the press head 31 is moved downward is controlled or adjusted to a desired value by the press unit controller 70. The speed at which the press head 31 moves before coming into contact with the ground electrode 12 may be set equal to that at which the press head 31 moves to press the ground electrode 12 downward.

The routine proceeds to step 4 wherein after the servomotor 32 has moved the press head 11 by the target distance L, the press unit controller 70 reverses the servomotor 32 to lift the press head 31 away from the ground electrode 12.

The routine proceeds to step 5 wherein the image processing unit 60 captures an image around the tips of the ground electrode 12 and the center electrode 11 to determine the ground-to-center electrode interval.

The routine proceeds to step 6 wherein it is determined whether the ground-to-center electrode interval measured in step 5 is greater than the target value d or not. If a YES answer is obtained, then the routine returns back to step 1. Alternatively, if a NO answer is obtained meaning that the ground-to-center electrode interval has matched up with the target value d, then the routine terminates.

As apparent from the above discussion, the spark plug gap adjustment apparatus of this embodiment is designed to determine the target distance L required to move the press head 31 for adjusting the spark gap 13 to the target value. Specifically, the desired spark gap 13 is defined only by moving the press head 31 the target distance L without measuring the interval between the center electrode 11 and the ground electrode 12 during the pressing of the ground electrode 12. Therefore, as compared with a case where the ground electrode 12 is pressed, as in the conventional apparatus, while the interval between the center electrode 11 and the ground electrode 12 is being monitored, the speed at which the ground electrode 12 is pressed may be increased greatly (e.g., up to 3 mm/sec.). The time required for steps 1 and 2 in the flowchart of FIG. 3 is very short (e.g., 0.1 msec. or less) and hardly reflects on the total time of the gap adjustment. The increase in press speed, thus, results in improvement of the productivity of spark plugs.

In the conventional spark gap adjustment method, the ground electrode is pressed, as discussed above, while the interval between the center electrode and the ground electrode is being monitored. Thus, if a stop signal is provided to the press unit at the instant the ground-to-center electrode interval has reached a desired value, the delay will occur between the input of the stop signal to the press unit and a time when the press unit is stopped actually, thereby causing the ground-to-center electrode interval to be decreased below the target value. In order to avoid this problem, the stop signal must be outputted to the press unit before the ground-to-center electrode interval reaches the desired value, which, however, results in an undesirable variation in ground-to-center electrode interval. The spark plug gap adjustment apparatus of this embodiment works to move the press unit only the target distance L, thus eliminating the above problem to minimize the variation in ground-to-center electrode interval. The inventor of this application has performed tests and found that the time required for the gap adjustment in the spark plug gap adjustment apparatus of this embodiment may be decreased to about one-third of that required in the conventional spark gap adjustment method, and the variation in ground-to-center electrode interval is reduced by half.

While the invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, if a NO answer is obtained in step 6 of FIG. 3 meaning that the ground-to-center electrode interval d1 as measured in step 5 is smaller than the target value d, the target distance L the press head 31 is to be moved downward may be corrected based on a difference between the measured interval d1 and the target value d in a subsequent spark gap adjustment. Specifically, after step 6, a correction value is determined according to an equation of (d1−d)/n where n is a preselected constant that is selected in a range of 2 to 6. In step 2, the target distance L is determined in the same manner as described above. The correction value is added to the target distance L. This avoids the production of spark plugs in which the spark plug gap 13 is smaller than the target value d and which have difficulty in adjusting the spark plug gap 13 again.

The image processing unit 60 defines a lower left corner of the rectangular range K in FIG. 2 as an origin of the xy coordinate system, but however, may determine a lower right, an upper left, an upper right corner of, or any point in the rectangular range K as the origin of the xy coordinate system.

What is claimed is:

1. A method of adjusting a spark gap of a spark plug comprising:

holding the spark plug having installed therein a center electrode and a ground electrode, the center electrode having a tip end, the ground electrode having an end with a first end surface and second end surface opposite the first end surface, the second end surface being opposed to a planar surface of the tip end of the center electrode;

measuring a location of the tip end of the center electrode to determine a target distance required to move the end of the ground electrode toward the center electrode for bringing a gap between the second end surface of the ground electrode and the planar surface of the tip end of the center electrode into agreement with a target value as a function of the measured location;

storing an initial location of a head of a press device, a thickness of the around electrode, and the target value in an image processing circuit;

determining a distance by which the head of the press device is to be moved as a function of the initial location, the thickness, the target value and the measured location of the tip end of the center electrode; and pressing the first end surface of the ground electrode toward the planar surface of the tip end of the center electrode using the press device to move the end of the ground electrode the target distance to bring the gap between the second end surface of the ground electrode and the planar surface of the tip end of the center electrode into agreement with the target value.

2. A method as set forth in claim 1, wherein the head of the press device includes a contact surface which comes in contact with an outer surface of the end of the ground electrode when the ground electrode is pressed and a stepped surface which continues from the first end surface and faces the end of the ground electrode through a given gap when the ground electrode is pressed.

3. A method as set forth in claim 1, further comprising measuring an interval between the end of the ground electrode and the tip end of the center electrode to determine whether the measured interval is greater than the target value of the gap between the ground electrode and the center electrode after the end of the ground electrode is pressed toward the center electrode through the press device and the step of correcting the target distance the ground electrode is to be moved toward the center electrode so as to compensate for a difference between the target value and the measured interval.

4. A method of adjusting a spark gap of a spark plug having a center electrode and a ground electrode, the center electrode having a tip end, the ground electrode having an end with a first end surface and second end surface opposite the first end surface, the second end surface being opposed to a planar surface of the tip end of the center electrode, the method comprising:

measuring a location of the tip end of the center electrode to determine a target distance required to move the end of the ground electrode toward the center electrode so as to establish an actual value associated with a gap between the second end surface of the ground electrode and the planar surface of the tip end of the center electrode in agreement with a target value;

storing an initial location of a head of a press device, a thickness of the ground electrode, and the target value in an image processing circuit;

determining a distance by which the head of the press device is to be moved as a function of the initial location, the thickness, the target value and the measured location of the tip end of the center electrode; and pressing the first end surface of the ground electrode toward the surface of the tip end of the center electrode to move the end of the ground electrode the target distance such that the actual value of the gap is in agreement with the target value.

5. A method as set forth in claim 4, wherein the pressing is performed with the press head having a contact surface coming into contact with an outer surface of the end of the ground electrode when the ground electrode is pressed and a stepped surface which continues from the first end surface and faces the end of the ground electrode through a given gap when the ground electrode is pressed.

6. A method as set forth in claim 4, further comprising:

measuring an interval between the end of the ground electrode and the tip end of the center electrode to determine whether the measured interval is greater than the target value after the end of the ground electrode is pressed; and correcting the target distance the so as to compensate for a difference between the target value and the measured interval.

7. A method of adjusting a spark gap of a spark plug having a center electrode and a ground electrode, the center electrode having a central axis extending longitudinally therethrough and a tip end, the ground electrode having an end with a first end surface and second end surface opposite the first end surface, the second end surface being opposed to a surface of the tip end of the center electrode, the surface of the tip end being located in a plane substantially perpendicular to the central axis of the center electrode, the method comprising:

measuring a location of the tip end of the center electrode to determine a target distance required to move the end of the ground electrode toward the center electrode so as to establish an actual value associated with a gap between the second end surface of the ground electrode and the surface of the tip end of the center electrode in agreement with a target value;

storing an initial location of a head of a press device, a thickness of the ground electrode, and the target value in an image processing circuit;

determining a distance by which the head of the press device is to be moved as a function of the initial location, the thickness, the target value and the measured location of the tip end of the center electrode; and pressing the first end surface of the ground electrode toward the surface of the tip end of the center electrode to move the end of the ground electrode the target distance such that the actual value of the gap is in agreement with the target value.

8. A method as set forth in claim 7, wherein the pressing is performed using the press head having a contact surface coming into contact with an outer surface of the end of the ground electrode when the ground electrode is pressed and a stepped surface which continues from the first end surface and faces the end of the ground electrode through a given gap when the ground electrode is pressed.

9. A method as set forth in claim 7, further comprising:

measuring an interval between the end of the ground electrode and the tip end of the center electrode to determine whether the measured interval is greater than the target value after the end of the ground electrode is pressed; and correcting the target distance the so as to compensate for a difference between the target value and the measured interval.

* * * * *